United States Patent [19]

Lemper

[11] Patent Number: 4,953,614

[45] **Date of Patent: * Sep. 4, 1990**

[54] MODULAR CONTINUOUS CASTER

[76] Inventor: Herbert Lemper, 130 Canterbury Rd., McMurray, Pa. 15317

[ * ] Notice: The portion of the term of this patent subsequent to Jan. 24, 2006 has been disclaimed.

[21] Appl. No.: 301,227

[22] Filed: Jan. 24, 1989

Related U.S. Application Data

[63] Continuation-in-part of Ser. No. 147,222, Jan. 22, 1988, Pat. No. 4,799,535, which is a continuation of Ser. No. 36,407, Apr. 9, 1987, abandoned.

[51] Int. Cl.[5] ..... B22D 11/00; B22D 11/08

[52] U.S. Cl. ..... 164/416; 164/418; 164/426; 164/442

[58] Field of Search ..... 164/416, 478, 441, 442, 164/425, 445, 446, 426, 418

[56] References Cited

U.S. PATENT DOCUMENTS 4,660,616 4/1987 Lemper ..... 164/426
4,799,535 1/1989 Lemper ..... 164/442

*Primary Examiner*—Kuang Y. Lin
*Attorney, Agent, or Firm*—Webb, Burden, Ziesenheim & Webb

[57] ABSTRACT

A modular slab caster or the like is provided having a flat foundation mat supporting a ladle turret module, a tundish module, a mold oscillator module, at least one adjustable segment module, a straightening module, a starting bar handling and charging module and a utility module, all on said foundation mat and rapidly connected and disconnected from one another to provide rapid installation of modules.

13 Claims, 12 Drawing Sheets

MODULAR CONTINUOUS CASTER

CROSS REFERENCE TO RELATED APPLICATIONS

This is a continuation-in-part application of my copending patent application U.S. Ser. No. 147,222, filed Jan. 22, 1988, now U. S. Pat. No. 4,799,535, which, in turn, is a continuation of U.S. Ser. No. 036,407, filed Apr. 9, 1987, now abandoned.

BACKGROUND OF THE INVENTION

This invention relates to modular continuous slab casters and the like and, particularly, to a continuous caster made up of readily interchangeable caster segments, all assembled on a flat foundation mat.

Continuous casters and, particularly, continuous slab casters, have been used for several decades to convert molten steel to a continuous slab of solid metal without the intermediate steps of forming ingots, reheating ingots and rolling the ingots to slabs. There have been a multitude of designs for such continuous casters and for the many parts out of which they are assembled. They have, however, remained as immense projects requiring months and years of construction and assembly at the location of the plant and millions of dollars in costs. In the past, such continuous casters have involved vast excavations with endless forming work and concrete casting in order to produce the necessary mammoth foundations riddled with tunnels, rooms, pipe and conduit. In such prior art casters, miles of conduit wire and pipe must be individually fit and assembled in situ. Much of the machinery and structural steel for assembling the caster arrives at the site as thousands of pieces somewhat like a giant "erector set" and, like an erector set, must be painstakingly fitted together on site, frequently under less than ideal conditions. The field forces required to assemble this complicated detailed caster assembly are a major cost item, as well as a major disruptive element in a working steel plant. As a result, continuous slab casters and the like require long construction periods and massive financing efforts and are effectively beyond the means of small producers, both timewise and costwise.

I have invented a continuous casting plant assembly which drastically reduces the time and cost of field assembly. My continuous caster assembly is placed on a single flat slab, eliminating the massive tunneled and roomed underfloor support structure of the prior art. The continuous caster of this invention is made up of multiple modules, each shop assembled and tested, which are moved into place of the flat slab and in effect "plugged in" to adjacent assembled units without any need for complex infield wiring and piping. This reduces the pre-operational testing of the facility to about 15% of that normally required in prior art caster assemblies and permits a shortened, simplified field schedule of about 3 months duration involving the placement of a flat slab of concrete and the placement and connection of the pre-assembled modules. This is compared to the year or more involved in prior art caster assembly.

The caster of the present invention also has the advantage of fitting into most teeming aisles of existing steel plants and thus makes possible the use of existing buildings and cranes. In prior art casters, this was not generally possible, thus requiring new buildings and new cranes, increasing the cost and time delay.

In the present invention, all caster assemblies are independent modules that are complete with utility piping and wiring. All modules have been assembled and aligned with all associated modules prior to leaving the manufacturer. The straightening section module with integral flume channel has a number of driven rolls to transport the slab, and the short top or bottom feeding starter bar. All driven rolls are equipped with a pair of cylinders, which permit these rolls to close onto the bottom driven rolls to pinch and transport the ½ inch thick starter bar. Additional segment modules contain the slab through the solidification point.

The starter bar handling and charging device is an independent module which loads the plate type starter bar onto itself. When disconnected, a rotating frame places the starter bar charging car into a horizontal position on the casting floor for starter bar head service, and to permit travel to the mold for starter bar feeding. The handling and charging device permits top and/or bottom feeding.

The entire modular caster can be completely assembled and aligned in any shop of a size with sufficient crane capacity. No machine component is left for field labor assembly.

The ladle turret module has an integral base which extends to the single foundation level. The turret is completely shop assembled with the turret bearing, drive assembly, lubrication piping and wiring in place. An additional, non-critical, bolted split is provided to separate the rotatable top from the base for shipment. Field labor need only install the base with built in bearing and rotating drive onto the embedded steel base plate and then place and bolt the rotatable top to the base.

The single level casting platform is designed to be prefabricated in modular forms to shift the emphasis from field construction to installation of modular assemblies.

The tundish car is designed to lift and lower the tundish for tundish nozzle insertion, to transfer the tundish in and out of the casting position and permit nozzle alignment with the molds. The large capacity tundish is equipped with throttling slide gates and has dams and weirs to promote float out of impurities. The tundish car also carries a part of the ladleman's platform which extends the modular floor mounted platform that carries the ladle shroud handler.

The mold design permits replacement of the mold jacket cartridge independent of the mold frame. Mold width can be automatically adjusted while casting.

The foundation mounted mold oscillator module has four eccentrics to generate the stroke, but is designed to eliminate all spherical bearings, bushing, pins, links and cam followers normally used for guidance. The mold oscillator permits very high oscillation frequencies, combined with extreme accuracy with virtually no wearing parts.

The oscillator base supports an adjustable segment in a manner permitting initial alignment of the segment by horizontal shifting without rotation, and rotation without horizontal shifting. Final machine alignment work in the field is reduced to checking and minor adjustments of pre-aligned components.

Labor forces are no longer required to field assemble machinery that should have been assembled in the manufacturer's work shop. The modular caster permits work shop assembly, alignment, and customer inspection of the whole caster at the manufacturer's plant before shipment.

Utility systems such as the electrical system, hydraulic system, water systems and instrumentation, are completely assembled in the form of system modules which we refer to as utility modules. The electrical system motor control room will be completely assembled at the manufacturer in a shippable module that can be placed near the caster. Hydraulic system pumps, tanks, filters, etc.; all equipment normally found in a hydraulic room, will be assembled by the hydraulic system supplier, inside a shippable module, which is then placed near the caster. Water systems and instrumentation systems will get the same treatment, so that all assembly and checkout is performed by the experts at point of manufacture, instead of by the field labor forces. The checked and tested control pulpit module is installed on the casting platform.

The utility modules and machinery modules are connected together by interconnecting modules which connect the various points on the machinery modules requiring coolant, electricity and hydraulic fluid to the sources in the utility modules.

The installation of the machinery modules, the interconnecting modules and the utility modules, which arrive at the job site in a virtually ready to operate condition, eliminate on site construction projects in favor of building block type installations.

The installation of interconnecting piping and wiring in the field typically takes a very long time and is extremely costly. Modular planning eliminates about 90% of all field installation of interconnecting wiring and piping. These modules which I have elected to call the interconnecting modules, are shippable, fabricated steel frames which are installed on the foundation mat near the machine components. They carry all the utility service lines and components in modular form. Interconnecting modules extend the utility lines along the casting machine by connecting to each other in series, and provide easily serviceable connections between the utility lines and the ultimate users on the machine. The only field work outside of the modular scope of coverage consists of the installation of the utility service line connecting the various utility modules to the interconnecting units. Transmission of electrical power, spray water, cooling water, compressed air, hydraulic fluid and lubrication grease is now accomplished through connectable, free-standing units, which are shipped to the job site as pre-tested modules.

Additional modules for the torch cut-off equipment and the runout tables complete the machine installation.

Some of the advantages of the ultra low head caster are lost if a vertical, straight mold caster or large radius caster is desired, but the general application and major benefits of the modular concept still apply.

SUMMARY OF THE INVENTION

I provide a modular continuous slab caster, and the like, made up of an elongated flat foundation mat for supporting the assembly, a ladle turret module including a ladle turret base having a rotatable ladle turret frame mounted on the top, an overhead single level casting platform frame on said foundation mat extending from a point adjacent the turret base lengthwise of the mat, a tundish module including a track supported transversely of said casting platform frame adjacent the ladle turret frame, a tundish car and a tundish movable into position on said car beneath a ladle in the ladle turret module, a mold oscillator module including a caster base frame, an adjustable slab mold removably fastened to said mold oscillator, at least one adjustable segment module removably carried within the mold oscillator frame, a straightening module supported on said flat foundation mat and made up of a frame and a plurality of successive segment top frames on said frame, a starting bar handling and changing module adjacent the casting platform frame end remote from the ladle turret and having a starter bar handling frame adjoining the casting platform frame, a starter bar charging car, a starter bar charging car carrier pivotally mounted on said starter bar handling frame for rotating said charger car between a vertical and a horizontal position in line with a trackway on the casting platform frame, and an interconnecting module on said foundation mat adjacent the casting machine modules and carrying pre-wired and pre-plumbed electrical and fluid lines with flexible plug-in connectors matching corresponding plug-in connectors in each module of the caster. Preferably the elongate flat foundation is of cast concrete with embedded steel support plates located on a single elevation with the mat surface to receive the separate modules.

The rotatable turret frame is preferably mounted on an annular bearing ring and driven by an electric motor and pinion drive engaging a ring gear as part of the rotating race of the annular bearing.

Preferably, the tundish car includes a lifting mechanism for raising and lowering the tundish to transfer the tundish in and out of casting position and permit nozzle alignment with the mold.

Preferably, the starter bar is a plate type bar and the charging car includes a rotating arm for rotating the starter bar assembly from a pick-up position to a feed position.

The mold oscillator module is preferably U-shaped so that one side is open for removal and insertion of the first adjustable segment module and the straightening module. Preferably the straightening module base frame is provided with a series of slots beneath the successive segment roll groups and with vertical slots extending from said continuous slot between each successive segment roll groups to permit expansion and contraction of the frame without distortion and/or resulting misalignment.

The slab mold may be either a curved or a straight mold, however, if a straight mold is used, the segment module is substantially straight and is followed by a bending segment module to progressively bend the product.

The first segment support in the mold oscillator module is preferably made in two sections; a top part and a bottom part, the top part being rotatable relative to the bottom part about a horizontal axis and the whole first segment support being horizontally shiftable to permit ease of alignment of the first segment module with the mold and the straightening module. The straightening module is preferably provided with a number of pairs of driven rolls, each pair having cylinders to move rolls toward and away from each other.

BRIEF DESCRIPTION OF THE DRAWINGS

In the foregoing general description I have set out certain objects, purposes and advantages of this invention. Other objects, purposes and advantages of the invention will be apparent from a consideration of the following description and accompanying drawings in which.

DETAILED DESCRIPTION OF THE INVENTION

Figure 1A:
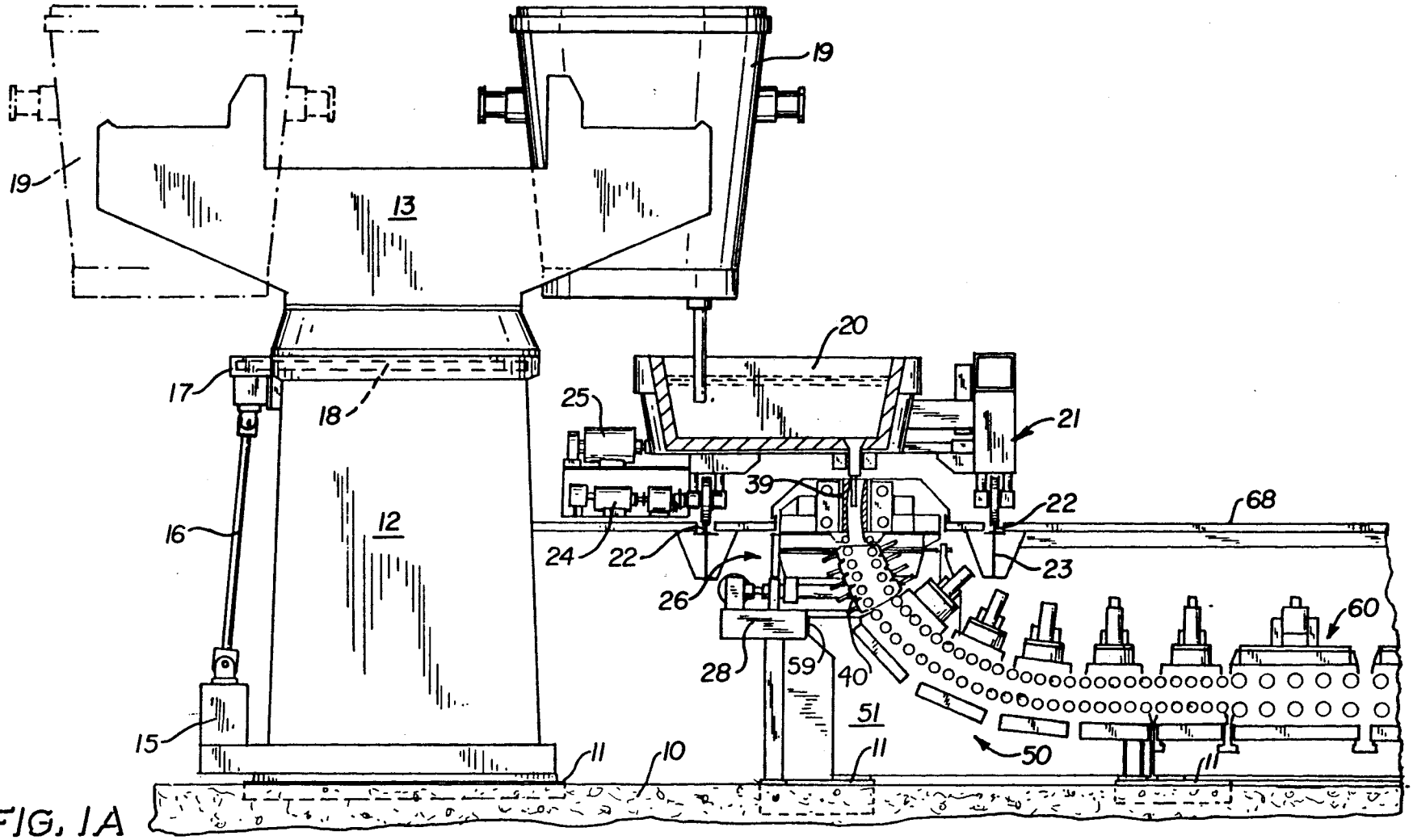
FIGS. 1A and 1B are a side elevation of a curved mold modular continuous slab caster according to this invention.

Referring to the drawings, I have illustrated in FIGS. 1 through 9 a curved mold continuous modular slab caster, according to this invention. A foundation mat 10 of cast concrete having a plurality of embedded steel support plates 11 for supporting the modules. A ladle turret module is made up of a turret lower base 12 with a rotatable ladle turret frame 13 mounted thereon. The turret base 12 is provided with an annular bearing (not shown) on which the turret frame 13 rotates and is driven by an electric motor (not shown) through gear drive 15 and through drive shaft 16 and pinion 17 engaging ring gear 18 on the turret frame 13. The turret frame 13 is adapted to hold a ladle 19 above tundish 20 carried on tundish car 21 running on track 22 supported on casting platform frame 23. The tundish car 21 is driven by a motor and gear train 24. The tundish 20 is raised and lowered on tundish car 21 by means of a lift assembly driven by a motor 25.

A mold assembly 39 consists of a mold frame 27 and narrow and broad face copper plates with water jackets to form a removable, cartridge sub-assembly. A rectangularly shaped mold opening (in plan view) is formed by the broad face plates 37, 37' and the narrow face plates (not shown). A typical slab cross-section cast by mold assembly 39 may be on the order of about 80 inches wide by 10 inches thick, for example. The mold cartridge can be removed from the frame quickly and easily for repair or rework. The cartridge is held to the mold frame by spring-loaded, hydraulically-relieved hold down devices 29. A similar device 29' holds the mold frame 27 to a mold table 38. The mold frame 27 includes width adjustment drives movably adjusting for the narrow faces on each end of the mold base frame to determine the width of the cast slab. The drives for moving the narrow face plates of the mold 39 are powered by D.C. stepping motors 30, FIG. 3. The mold, as shown in FIG. 4, includes a curved broad backface mold copper plate 37 and a spaced, curved broad frontface mold copper plate 37, The curve of the mold plates 37, 37' may be, for example, formed on a 5 meter radius. The spacing between plates 37, 37' determine the thickness of the cast slab. The backs of all the copper plates 37, 37' have conventional multiple vertical slots, for cooling water flow (not shown).

A pair of foot rolls 31 are supported in anti-friction bearings, on adjustable brackets, and attached to the bottom of the mold assembly 39. Foot rolls 31 are preferably non-driven and guide the opposed broad faces of the curved cast slab as it exists from the bottom of mold 39 prior to entry into a next roll segment 40 of the casting machine.

A mold oscillator apparatus 26 is mounted on a frame 28 having four legs which rest on support pads 11 on the mat 10. The mold oscillator 26 is journaled to four rotating eccentrics 32, 32' on the respective ends of a pair of shafts 34 which are supported for rotation in bearings 36 mounted on the frame 28. The two shafts 34 are driven by a motor 35 and right angle gear reducers 34*a* mounted on frame 28. The bearing mounted eccentrics 32 act on the four corners of an upper mold table assembly 38 to oscillate it and the adjustable mold 39 carried thereon.

As stated, the mold oscillator 26 has two shafts 34 with two offset eccentrics 32, 32' on each shaft. One eccentric is positioned under each corner of the mold table 38 to eliminate oscillating inaccuracies with small stroke, high oscillation frequencies. A vertical oscillating stroke length of about 4 mm at the backface mold 37 casting radius has been found to be satisfactory. A slightly higher oscillating throw or stroke length at the outer mold face 37' is preferred as will be explained in more detail hereinafter. The four eccentrics 32, 32' provide a very accurate vertical oscillatory motion. A D.C. drive motor 35 of fifty horsepower and an oscillation frequency within the range of 20–400 strokes/minute provide good results.

The axes of rotation of eccentrics 32' near the outside radius mold plate 37, are offset a greater distance from the axes of rotation of the shafts 34 than the offset axes of the eccentrics 37 and, thus, have a larger throw than the eccentrics 32 near the inside radius plate 37. This feature permits the mold to rotate slightly as it oscillates and to follow its curved radial casting path. Since the eccentric oscillator shafts 34 are driven by the common motor 35 coupled to the right angle bevel gear reducers 34*a*, very little vibration and wear of moving parts is experienced.

The proper horizontal location of the mold 39 throughout the oscillation stroke is accomplished through the use of check rods 49 attached to the oscillator base 28 and the mold table 38. Locating the mold table in the casting direction is accomplished by utilizing check rods also. No prior art guide rollers, with bearings that require lubrication and eventually cause wear problems, are used. Adjustability of the check rods permits very accurate location of the mold table.

Vertical mold oscillation in the prior art is normally accomplished by eccentrics, which operate separate links, connected to the mold table by spherical bushings or bearings to transmit the oscillatory motion to the mold table. The extremely small rotation of these bushings causes lubrication failure in the loading zone resulting in rapid wear and excessive clearances. To avoid these problems, the oscillatory motion transmitting links of the invention are solid members 57 welded to the mold table 38 and not connected through bearings as in the prior art. Built-in elastic flexibility inherent in the present design permits free rotation of the eccentric shafts 34. The links of the invention consist of standard wide flange beams 57 with a web thickness resulting in extremely low stress, while permitting deflection in the horizontal directions, and high column strength to transmit the vertical oscillation forces, see FIG. 4B. As seen in FIG. 4B, wide flange beams 57 are weldably secured to the bearing housings of the eccentrics 32, 32' at the lower flanges and to the mold table 38 at the upper flanges.

Figure 3:
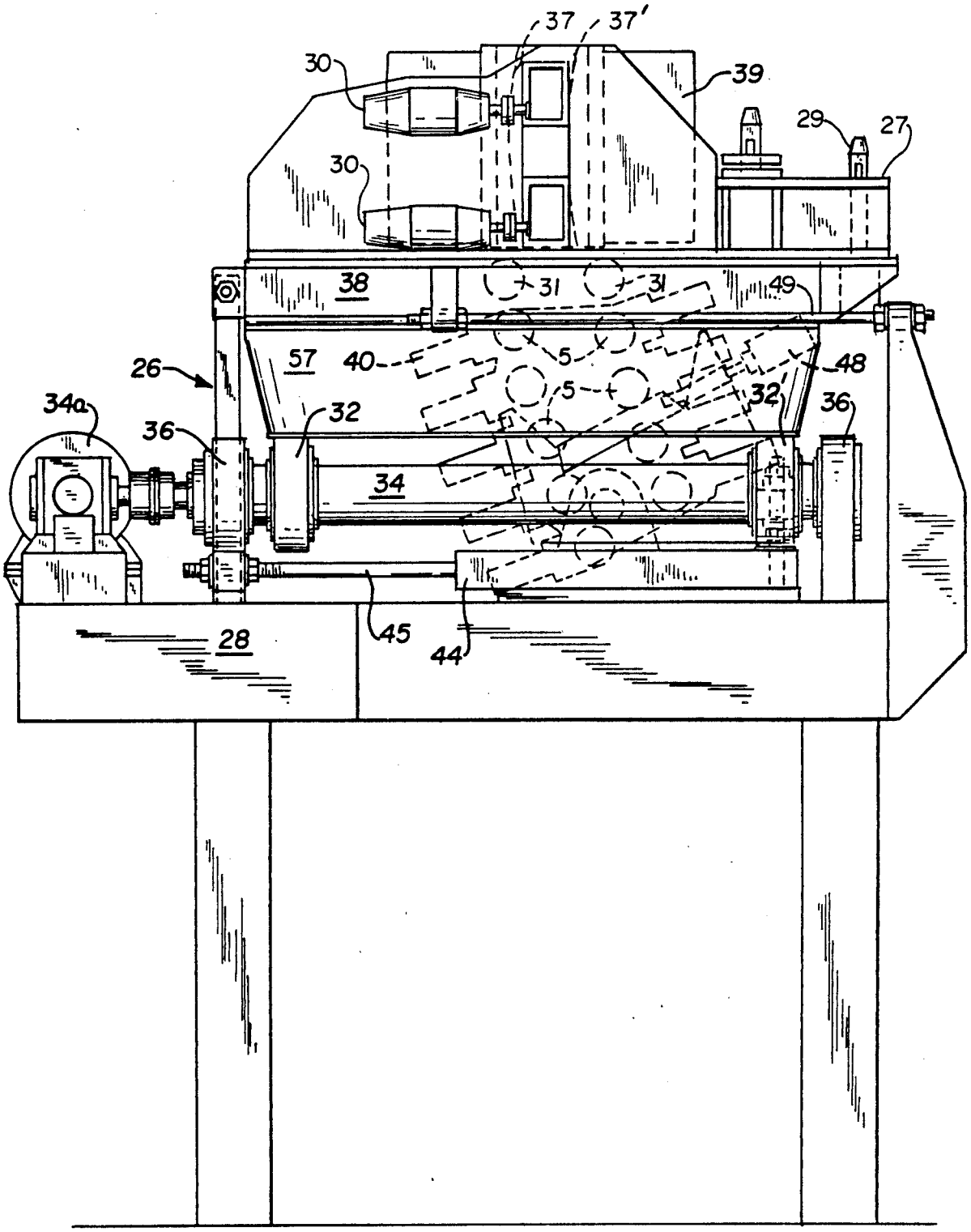
FIG. 3 is a side elevational view of the mold module and oscillator module with an adjustable segment module therein in chain line.
Figure 4:
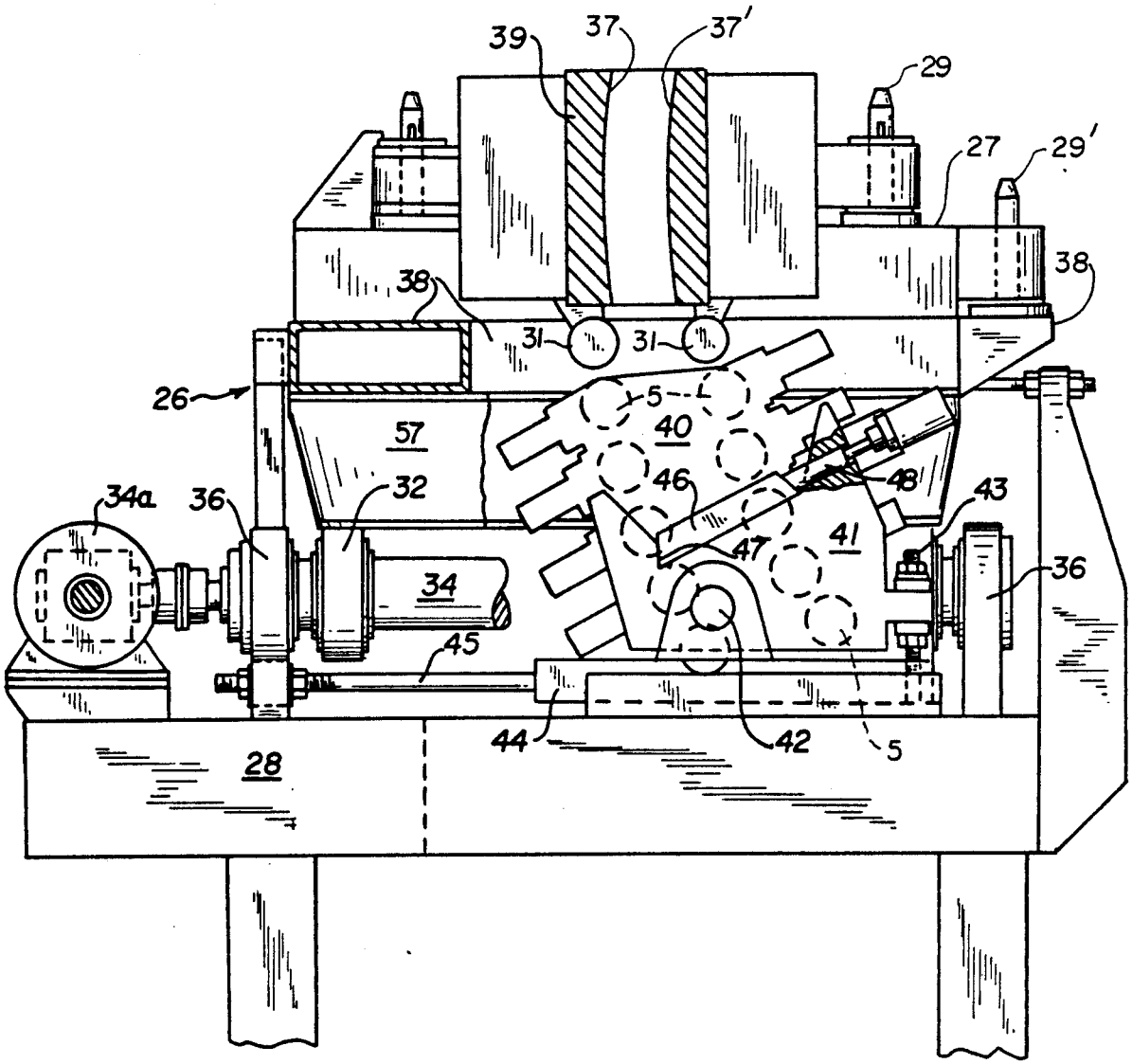
FIG. 4 is a sectional view, partly in elevation of the structure of FIG. 3.
Figure 4A:
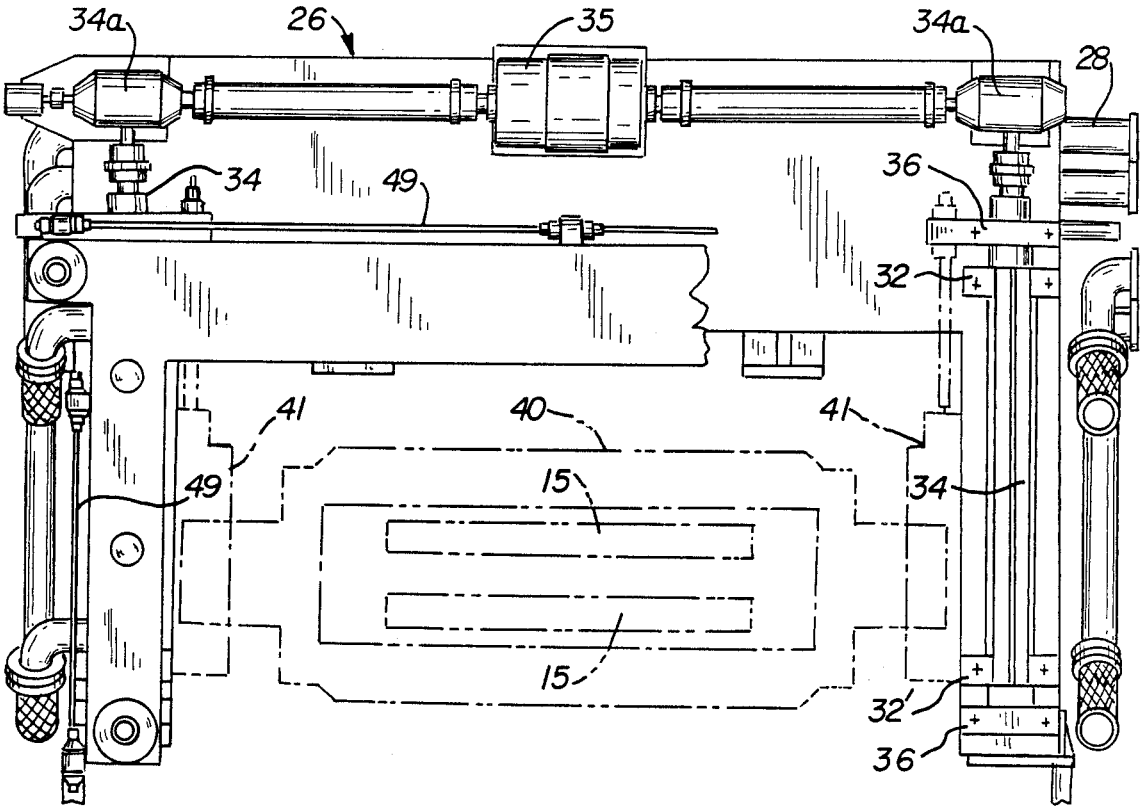
FIG. 4A is a top plan view of the mold oscillator module.
Figure 4B:
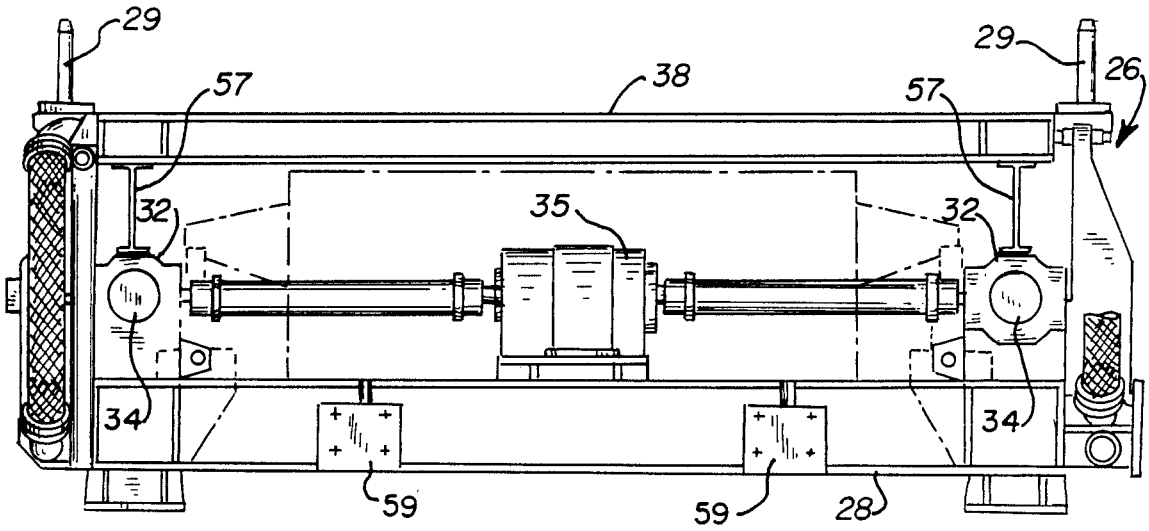
FIG. 4B is a rear elevation of the mold oscillator module of FIG. 4A.
Figure 5:
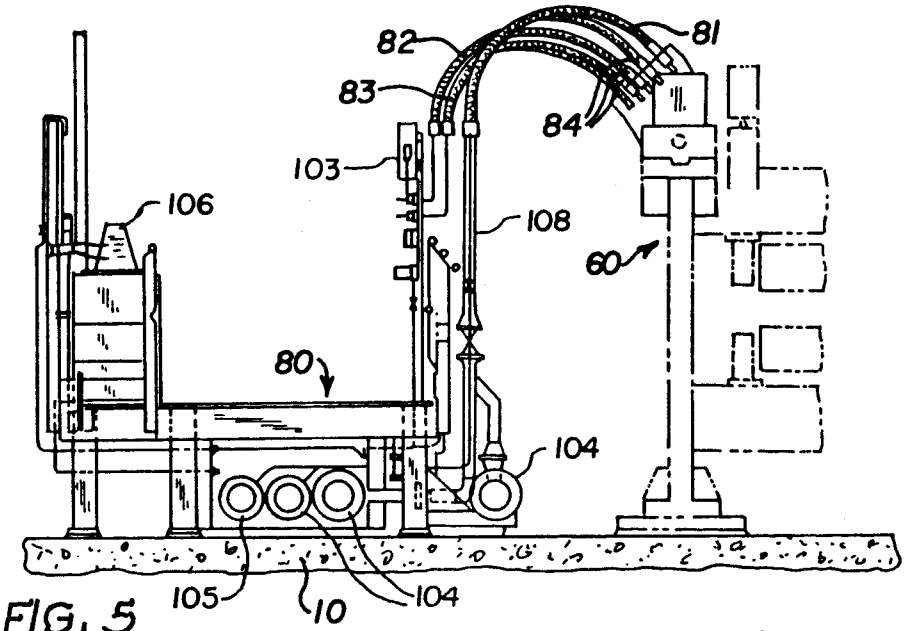
FIG. 5 is an end elevation of the interconnect module for the curved mold assembly of FIGS. 1A and 1B.

The oscillator base frame 28 contains two laterally spaced carriers or supports 41 designed to permit horizontal shifting and rotational motion for easy and accurate initial adjustment of a first segment module 40, FIG. 3, 4 and 4A. Each carrier 41 is equipped with a hydraulic clamping cylinder 48 to secure the first segment 40 in a proper position relative to the casting radius. The carriers 41 supply all utilities to the first segment module 40 (not shown).

Overlapping shields protect all the mechanical components from a spray chamber environment located within the frame 28.

The oscillator base frame 28 is supported by a four-column support frame, forming the spray chamber columns, in the oscillator area, complete with a centrifugal exhaust fan and access doors on two sides of the chamber (not shown).

It is important to note that the oscillator base frame 28 and the mold table 38 are open at the forward end to facilitate easy overhead crane removal of the first segment 40 as well as the straightener strand guide section 50, whose function will be explained in greater detail hereinafter.

The adjustable first segment module 40 is supported on the segment support 41 mounted on trunnions 42 and adjustably pivoted thereon by a vertical jack screw 43. The segment support 41, trunnions 42 and adjustable screw 43 are mounted on a sliding base 44 on the base frame 28 and adjustably moved in a horizontal direction by a jack screw 45. The adjustable segment module 40 is supported on the segment support 41 by means of laterally extending feet 46 carried by the segment module frame. The feet 46 rest in wedge grooves 47 carried by the segment support member 41 and are locked in the grooves 47 by the hydraulic operated ram 48. The segment module 40 contains a plurality of spaced rolls 5 and continues the same strand curve radius as that established by the broad face plates 37, 37' of the mold 39.

The design of first segment 40 permits the exchange of the individual rolls 5 from the outside of the first segment 40 without disassembling the segment. This design also provides easier alignment of the segment between the mold 39 and the straightening segment 50, and will consequently result in better alignment for better slab quality and fewer breakouts of molten metal within the first segment.

As stated previously, the side frames of curved first segment 40 are equipped with large, rigid feet or trunnions 46 which provide a superior support for the segment 40 in the oscillator base frame 28. Initial alignment of the roll pairs 5 and the segment support frame can be accomplished by the horizontal shifting and rotating provisions in the oscillator frame 28 by way of jack screws 43, 45. Segment 40 is assembled and aligned outside of the caster in a known manner in an alignment stand (not shown) which provides the same mounting to the casting radius relationship as the caster. After the segment is placed into the oscillator frame 28, the previously described hydraulic clamps 48 locate and clamp the trunnions 46 of segment 40 into the accurate position for casting. All utility connections for segment 40 (spray and machine cooling water, grease) are automatically made by couplings (not shown) when the segment is placed in the oscillator frame 28.

Through the two degrees of freedom of movement provided by the pivot 42 and jack screws 43 and 45, the first segment 40 can be horizontally shifted without rotation and it can be rotated about pivot 42 without horizontal shifting. This feature makes the alignment task much easier than prior systems where slight horizontal alignment movement often causes rotational misalignment of the strand guide rollers 5, and vice versa.

The strand guide system guides the cast slab from the vertical mold 39 to a horizontal runout table located beyond the downstream roll segments 60. As stated, the adjustable first segment 40 is supported on the oscillator frame 26. Straightening module 50 is made up of roll segments A–D, FIGS. 1A, 2, and is positioned immediately downstream from the first segment 40. The plurality of segments 60, are independent roll segments which follow the straightening module 50 and are mounted on three or more modular horizontal segment carriers 110 mounted on foundation plates 11 at floorline elevation. All bearing housings and rollers are internally water cooled. Internally water cooled heat shields or passages are placed between slab and frames to avoid heat damage to frames (not shown). Four straightening points A–D, for example, all located in the curved strand straightening module 50, will straighten the slab gradually from a 5-meter radius to straight. All rolls are preferably manufactured from alloy steel for strength and resistance to heat cracking.

The straightening module 50 rests on steel support plates 11 in the concrete mat 10. This module is made up of a base frame 51 which is keyed at 51, at its forward end to foundation support plate 11, FIG. 2. This keying prevents thermal expansion movement of frame 51 in the forward direction and thus causes thermal expansion of frame 51 only in a rearward direction since the rearward support lug 58 is not keyed and is free to move on its respective steel support plates. The frame 51 carries all of the bottom rolls 52 of the roller pairs of the straightening module 50 and a number of top sections 53 which support the top rolls **53*b* preferably in groups of five in each of the roll segments A–D. The center roll of each of the top sections and their mating rolls in the bottom section are preferably driven rolls. Each top section 53 of the segments A–D also carries two hydraulic cylinders 54, one on each side, that force the top section against spacers (not shown) to provide the proper roll gap between the top and bottom rolls to contain the newly cast slab without squeezing the slab such as might cause internal slab damage. A typical slab thickness may be about 10 inches, for example. Additional hydraulic cylinders 55** are provided to force the driven top roll onto the driven bottom roll to pinch the plate type starter bar, hereafter described.

The base frame 51 of the straightening module 50 is provided with slots 56 that are located at right angles to a radial line drawn from the center roll of each five roll top sections 53 of segments A–D. The remaining connections between the lower part of the base frame 51 and upper part of the base frame carrying the bottom rolls are slender columns 57 which will permit heat expansion of the top and bottom parts of the base frame 51 without causing distortion. The direction of the slots 56 is generally tangential to the casting radius prevalent at each group of rolls in segments A, B, C and D. This slot direction assumes that any expansion of roll groups will occur parallel to the casting radius and thus will cause no roll misalignment. This design eliminates the need for conventional segment carriers used on conventional casters. In addition, due to the fact that the forward end of the lower part of the base frame 51 is immobilized by key 51,, the longitudinal thermal expansion of the lower base frame is in a rearward direction. The longitudinal expansion of the upper part 53 of the base frame 51 is in an opposite direction and will thus cancel out the expansion of the lower part.

The strand guide frame 51 of module 50 is made of heavy welded construction to provide the rigidity needed to maintain alignment accuracy for the strand guide system. The side frames of the guide frames are connected through permanent separators which provide the mounting for the bottom roll bearing housings for segments A through D. The side frames are also contoured to provide attachment and guiding for the independent top roll support frames for segments A through D. The series of relief slots 56, and columns 57 through the side frames parallel to and below the bottom roll support separators eliminates heat expansion distortion of major frame members.

The strand guide module 50 mounts directly to foundation plates 11 located on a single plane in the foundation mat 10. The keys 51' are used between the strand guide frame 51 and the foundation plates 11 to retain alignment as well as for the controlled thermal expansion discussed above.

The aforementioned open-ended design of the oscillator frame 26 permits the complete curved strand guide frame 51 of module 50 to be vertically removed and replaced as a single unit. A pre-aligned replacement module 50 is easily aligned with the casting radius when installed on the keyed foundation plates and with the bolted flanged interface at 50 (FIG. 1A) on the oscillator base frame.

The straightening module 50 is followed by additional strand guide segments 60 which carry the slab to run out tables and cut-off equipment of conventional form.

All roll segments, except adjustable first segment 40, are equipped, for example, with five roll pairs and two hydraulic cylinders for clamping force to maintain the proper roll gap. Two additional cylinders are used to advance the center rolls together for starter bar operation. Clamping cylinders are sized to withstand the ferrostatic force of the slab. Four shimmable spacers, one at each corner of the segment, are used to set the roll gap for a 10-inch slab thickness, for example.

The center pair of rollers on each of the segments 60 are driven. The driven rollers provide power for slab withdrawal and for gripping the starter bar tail. The top driven roller of each pair of driven rollers is independently actuated by hydraulic cylinders. This enables it to pinch the 0.5 inch thick starter bar tail during insert and slab withdrawal, and then return to the proper roll gap position.

All roll segments of module 50 are aligned on the segment alignment stands outside of the machine. The alignment stand for the curved strand guide enables segments A–D to be aligned as a single unit and facilitates quick exchange of the curved strand guide of straightening module 50 as one assembly.

The roll segments 60 are supported in modular carriers 110 made of a heavy welded construction to provide the rigidity needed to maintain alignment accuracy throughout the strand guide system. Each segment carrier 110 is fixed by keys 101 at an upstream end to plates 11 and is thus free to thermally expand toward the downstream end. Each carrier 110 has four feet which rest on the steel foundation plates 11, FIG. 1B. Segments 60 are held onto the carriers by four double wedge assemblies that are located at each of the four corners of the segment (not shown). Once a segment 60 is aligned with the passline and positioned on the carrier 110, exchanged prealigned segments retain alignment with the passline due to the keyed pads on each segment foot which fix the location of the segment while permitting necessary expansion to prevent binding. Segment carriers 110 also contain fabricated flume sections (not shown) to guide spray water flushing water and scale into the foundation mat embedded flumes.

Figure 1B:
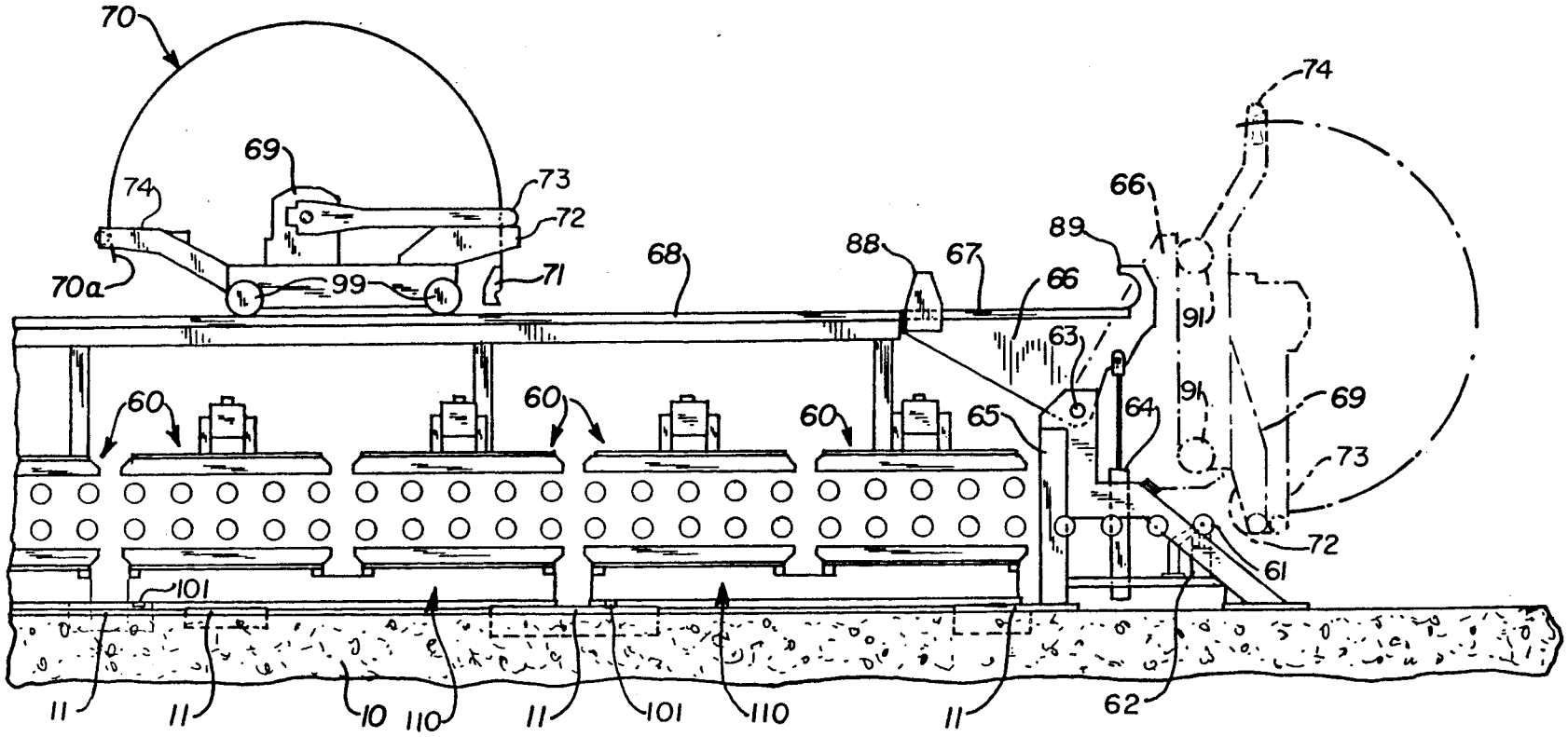
Figure 2:
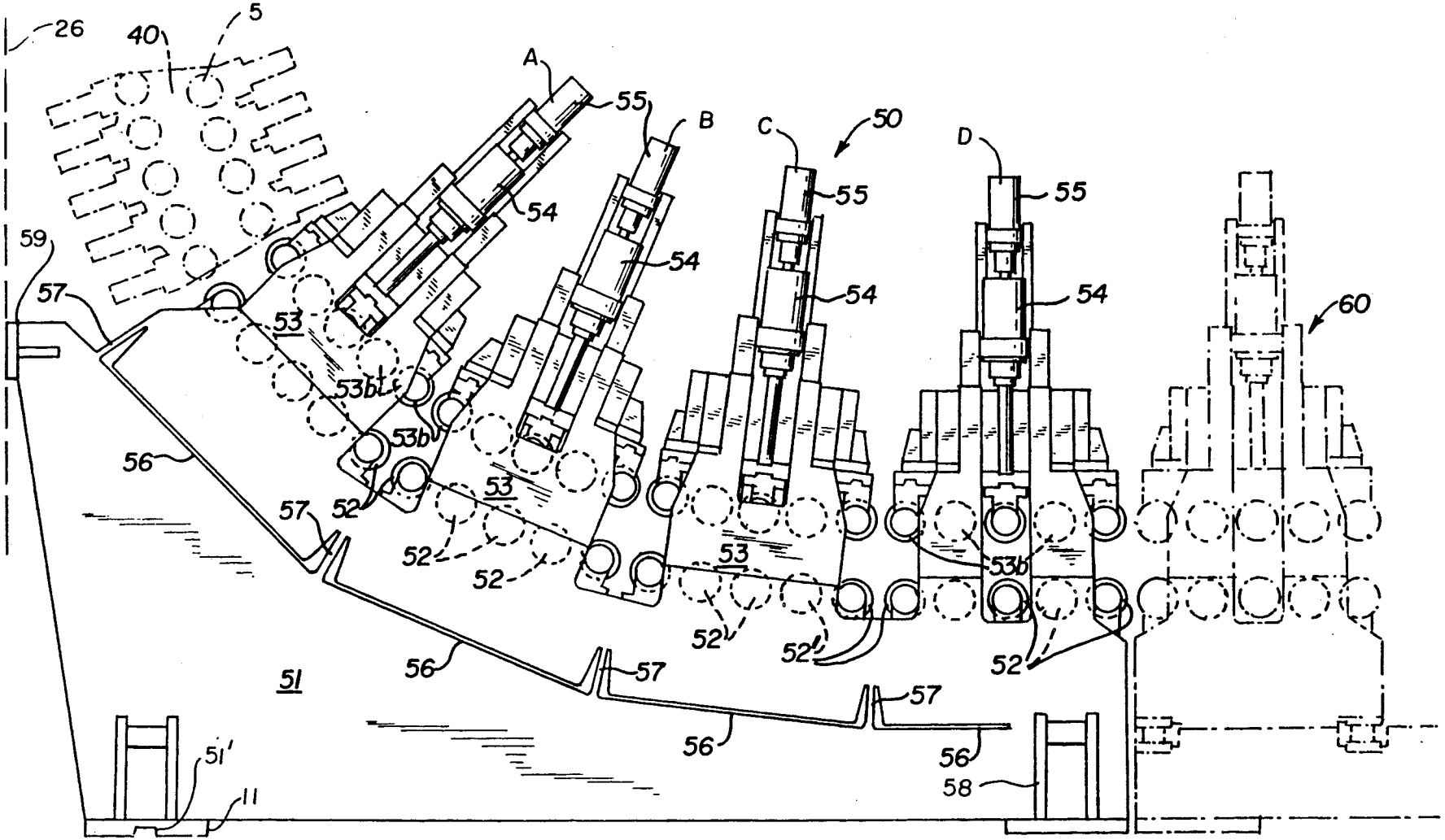
FIG. 2 is a side elevational view of the straightener module of FIG. 1A.

At the downstream end of the strand guide roll segments 60, a starting bar handling and charging module is provided and made up of a vertical frame 65 having a starter bar charging car carrier 66 pivoted thereon, FIG. 1B. The starter bar charging car carrier 66 has trackway 67 thereon which matches a trackway 68 on the casting platform frame. The charging car carrier 66 pivots from a position in which the trackway 67 and charging car 69 thereon are in a vertical position (shown in chain line in FIG. 1B) to an horizontal position in which the charging car 69 is movable onto trackway 68 to a position adjacent adjustable mold module 39 where a leader **70*a* of the starter bar 70 can be fed into the mold module 39. The carrier 66 has spaced pairs of wheel retaining devices 88, 89 for holding the forward and rear wheels 99 of the car 69 so as to keep the car on the carrier and on the track 67 when the carrier 66 is in the vertical position. The plate type starter bar 70 is fed into the mold module 39 by feeding leader 70*a* through the rolls of the adjustable first segment 40 into the driven rolls of the straightening section module 50 until the enlarged starter bar head 71 is located in the mold module 39 to engage the liquid steel being poured into the mold. The chilling liquid steel solidifies around the claw-type starter bar head 71. The driven rolls of the straightening section 50 then transports the starter bar assembly with starter bar head 71** in tow through the strand guide system to engage the forward end of a semi-molten slab coming through the straightening module.

As previously described, the starter bar 70 is designed to carry the starter bar head 71 into the mold to provide a bottom in the mold 39 at the beginning of a cast. The starter bar head is of the claw-type design which permits highest pulling forces while capable of being readily disconnected from the slab when desired. As seen in FIG. 1B, a movable starter bar disconnecting roller 61 is mounted in the support frame of the starter bar carrier module 66. The starter bar head 71 is lifted out of the cast-on strand by a hydraulic cylinder 62 to elevate the disconnect roller which is positioned beneath the head 71. The head 71 is adjustable in intermediate widths by using width adjusting plates or spacers (not shown).

Driving forces are transmitted to the plate type starter bar 70 by the use of driven pinch rolls in module 50 and segments 60 which are hydraulically forced together against the starter bar plate. Pinch rolls are opened individually and retracted to be in line with all other inside radius rolls when the head adaptors and the head of the starter bar pass by. Pinch rolls remain in their retracted position for slab withdrawal until the next starter bar cycle.

The starter bar handling or carrier module is an independent module complete with a rotating frame 66 which carries the starter bar charging car 69 and disconnects roller mechanism 61. The starter bar carrier module is also supported on foundation mat 10 and the embedded steel base plates 11.

When the starter bar tail end 70*a* leaves the last roll guide segment 60, it enters a first fixed arm 72 of the starter bar handling car 69. All hydraulic arm clamps 76 are open on both the fixed arm 72 and rotating arm 73. When the bar has passed through the fixed arm 72, the hydraulic cylinders 76 in the rotating arm 73 will clamp the tail end of the bar. The rotating arm will deflect the starter bar as it withdraws the bar at casting speed. Details of the starter bar charging car 69 are shown in FIGS. 12 and 13.

After the rotating arm 73 has travelled 180°, the cylinders of the fixed arm 72 clamp the bar. The starter bar disconnect roller 61 lifts the claw-type head 71 out of the slab end while the hydraulic cylinders 62 and 64 of the rotating and lifting frame 66 are energized to rapidly remove the head from the cast slab to avoid any possibility of reconnection with the cast slab.

The rotating carrier frame 66 pivots about shaft 63 motivated by hydraulic cylinder 64 and completes its rotation of 90°to place the starter bar charging car 69 in the horizontal position. This horizontal position is the normal parked position in which the starter bar head 71 is serviced for the next cast. When the cast slab has cleared the mold and upper segments of the caster, the starter bar charging car approaches the mold 39 to begin feeding the bar tail 70*a* into the mold. At this point, hydraulic clamps 76′ of a second fixed arm 74 release the bar end 70*a* to permit the movable arm 73 to feed the bar 70 and head 71 into the mold. The tail end (or leading end) 70*a* of the bar is engaged by driven roll pairs in module 50 when the starter bar head 71 is positioned inside the mold for packing and the beginning of a new cast. The starter bar car 66 then returns to the rotating frame 69 and is rotated to the vertical position near the last segment 60 to receive the end 70*a* of the starter bar during the start of a new casting sequence. The starter bar handling device permits top or bottom feeding of the starter bar.

Figure 12:
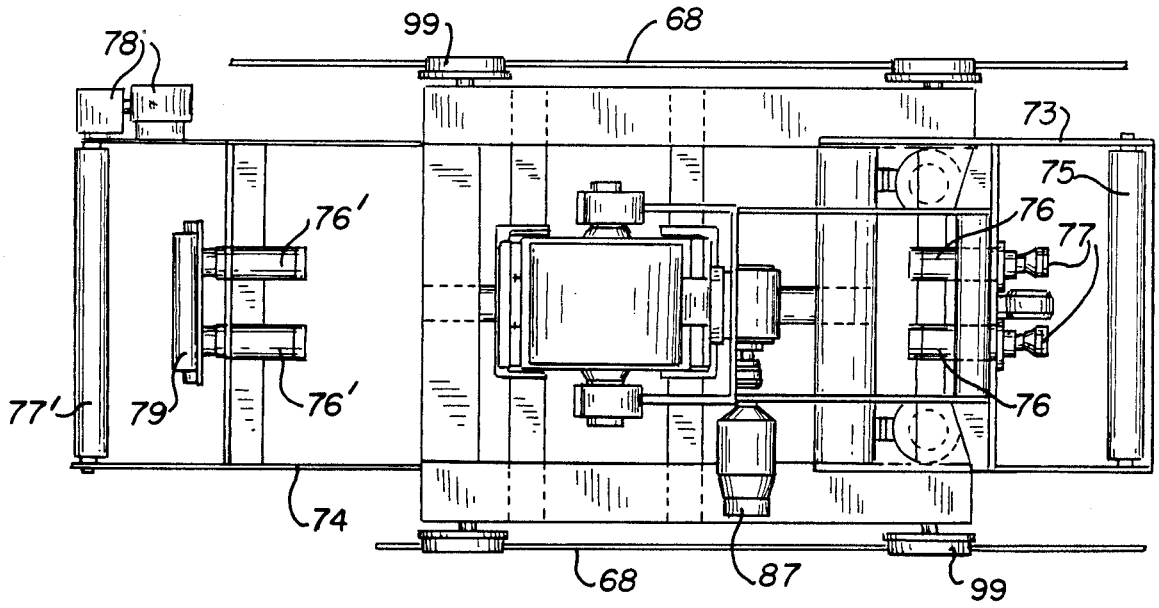
FIG. 12 is a top plan view of the starter bar charging car of the present invention.
Figure 13:
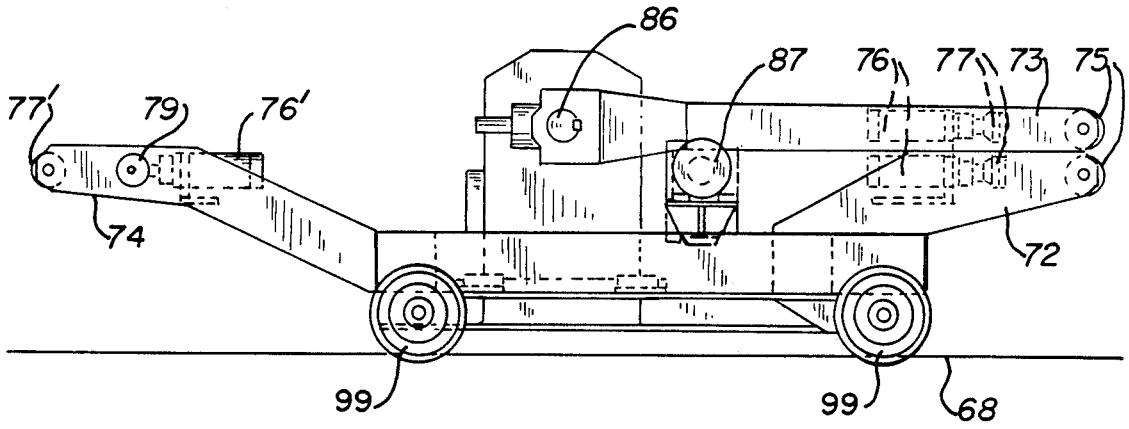
FIG. 13 is a side elevational view of the charging car of FIG. 12.

As seen in FIGS. 12 and 13, the starter bar charging car 69, carries idler guide rollers 75 on the arms 72 and 73 which engage the outer surface of the starter bar 70 as it is manipulated thereby. The starter bar is locked against the rollers 75 when the rams 77 of the hydraulic cylinders 76 are extended to engage the starter bar and hold it firmly against the rollers 75. The second fixed arm 74 of the charging car 69 preferably carries a roller 77, which is driven by a motor and gear unit 78. A pair of hydraulic cylinders 76′ on the second arm 74 carry an idler roller 79 which is extensible to contact the starter bar 70 for gripping and feeding purposes. The movable, bifurcated arm 73 pivots about a shaft 86 by way of an appropriate DC motor 87 which may also drive the car 69 along the spaced rails of trackway 68 of the caster.

The interconnecting modules 80, are placed adjacent the caster modules 40, 50 and 60 on the foundation mat 10. These modules are provided with flexible water 81, hydraulic 82 and electrical lines 83 with quick connector ends 84 for attachment to each component of the caster modules. These interconnecting modules 80 carry all valving for the hydraulic and coolant systems as well as all field instrumentation and a grease system. Each interconnecting module is of an overland shippable size such as, for example, not exceeding 43 feet long and 8 feet wide, and is pre-assembled at the factory. The interconnecting modules 80 eliminate the need for about 90 per cent of in-field wiring and piping typically called for in conventional caster construction jobs and supply all utilities to the caster modules. There are preferably three interconnecting modules 80 employed, which are joined end-to-end to each other at couplings 102, FIG. 6. An interconnecting module 80 may typically carry three hydraulic panels 103, pipes 104 for water supply and return, air pipes 105, a grease pump station 106, hydraulic lines 107, spray water pipes 108 and like components. Expansion joints 109 are also employed at the pipe joints between interconnecting modules 80.

Figure 9:
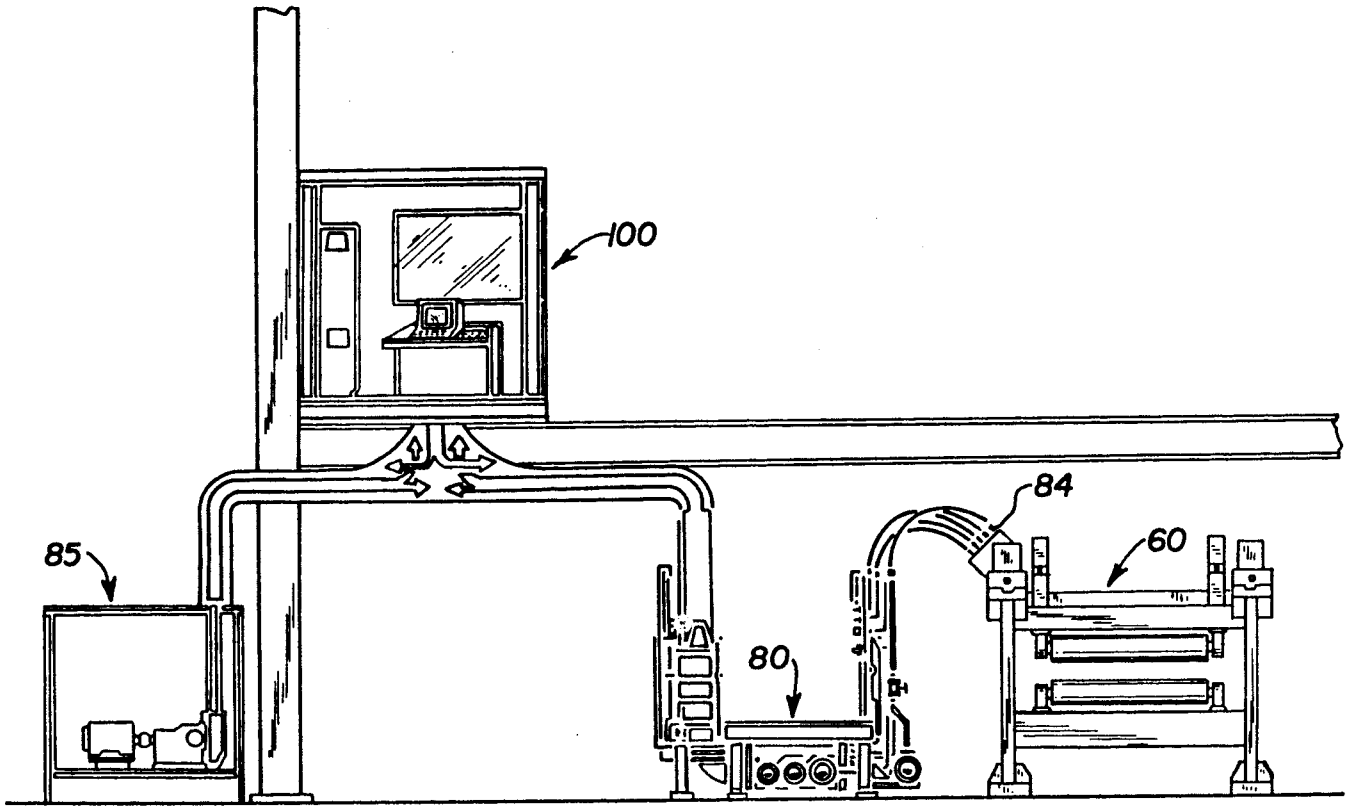
FIG. 9 is a section through a modular caster assembly of this invention showing the utility module, control pulpit module, interconnecting module and the caster module.

As seen in FIG. 9, the main feed lines for all utilities are brought to the interconnecting modules 80 by utility modules 85. The utility modules contain the input systems for all the utilities such as water systems for filtration, cooling and pumping, air compressors for cooling air, hydraulic systems including tanks, pumps, filters, accumulators, heaters and coolers. Utility modules 85 are also assembled at the factory in shippable sizes and are placed with respect to the interconnecting modules, to provide the shortest and least complicated connections between them. I have found that three such utility modules 85 are suitable. The three utility modules 85 comprise two electrical system modules and one hydraulic power system module. The ability to assemble and test the hydraulic and electrical system modules 85 before they leave the manufacturer's plant eliminates the need for long periods of construction, flushing, checking and testing in the field.

A pre-assembled control pulpit module 100, generally located on top of the casting floor, is provided with the necessary controls for controlling the functions of the utility and interconnecting modules as well as all controlling and monitoring devices for the casting modules and the various other modules of the continuous casting assembly.

Figure 10:
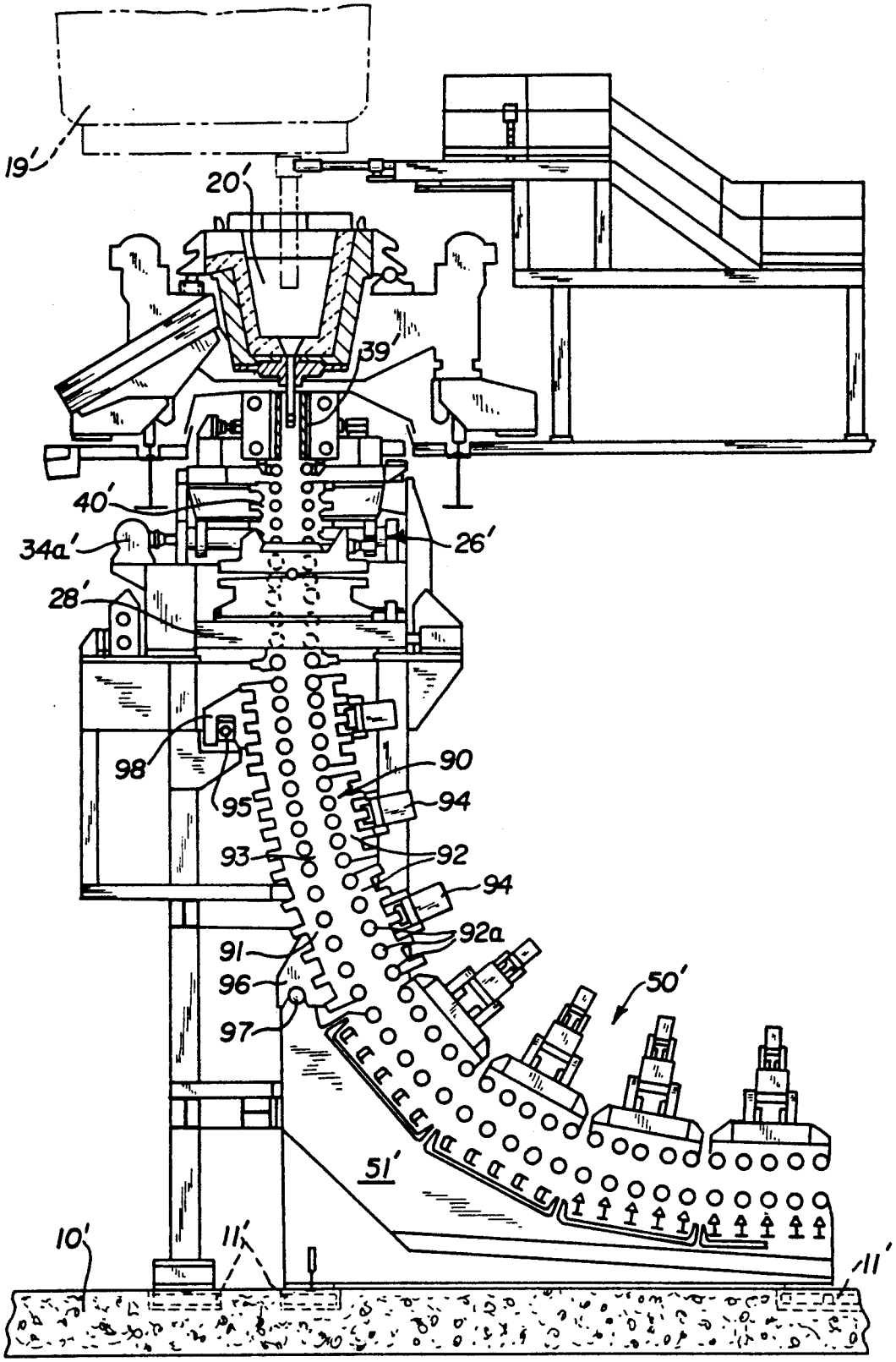
FIG. 10 is a side elevation of a straight mold oscillator module, a straight adjustable segment, a curved adjustable segment and a straightener segment according to a second embodiment of this invention.
Figure 11:
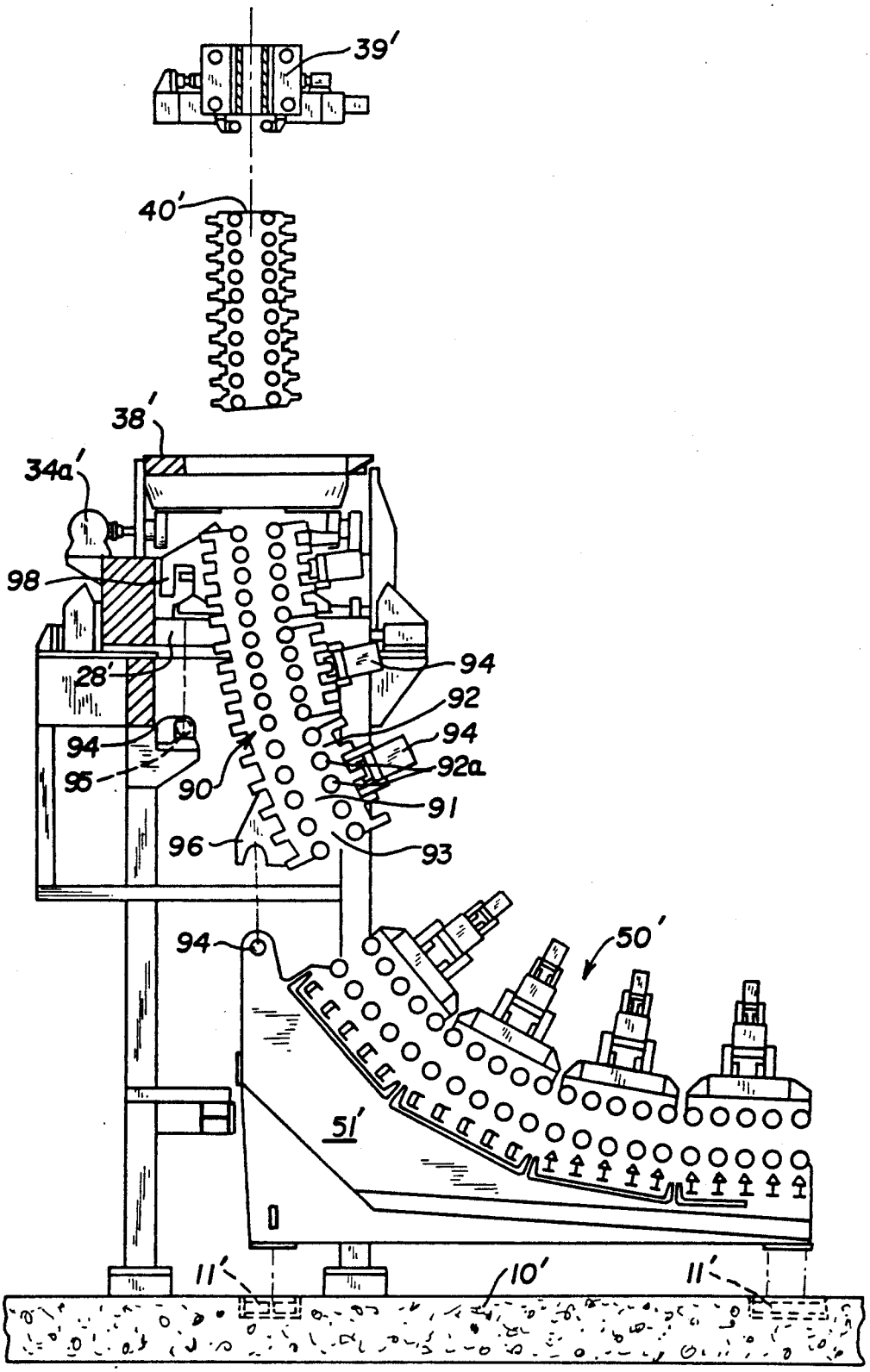
FIG. 11 is an exploded side elevation of the straight mold caster of FIG. 9.

In FIGS. 10 and 11, I have illustrated a similar module caster for use with a straight mold. This is essentially the same as that illustrated in FIGS. 1 through 9 except for being higher and requiring the use of a second curved adjustable segment. In this structure, those elements corresponding to elements of FIGS. 1–9 are given the same identifying numbers with a prime sign.

In the embodiment of FIGS. 10 and 11, the mold 39′ is straight instead of curved as is also the first segment module 40′. In this embodiment, I add a bending adjustable module 90 which is made up of a frame 91 carrying segments 92 with rolls 92*a*. Each top segment is adjustable by means of cylinders 94 to close down on the starter bar. The bending segment 93 is supported at its lower end by hooks 96 on pins 97. The upper part of the bending segment 93 is guided by hooks 98 that engage parallel sided blocks 94 located with pins 95. The guiding surfaces of these blocks are parallel to the path of the slab at that location so that any heat expansion of the bending segment 93 will not cause misalignment between rolls of the straight first segment and the upper rolls of bending segment 93.

Figure 6:
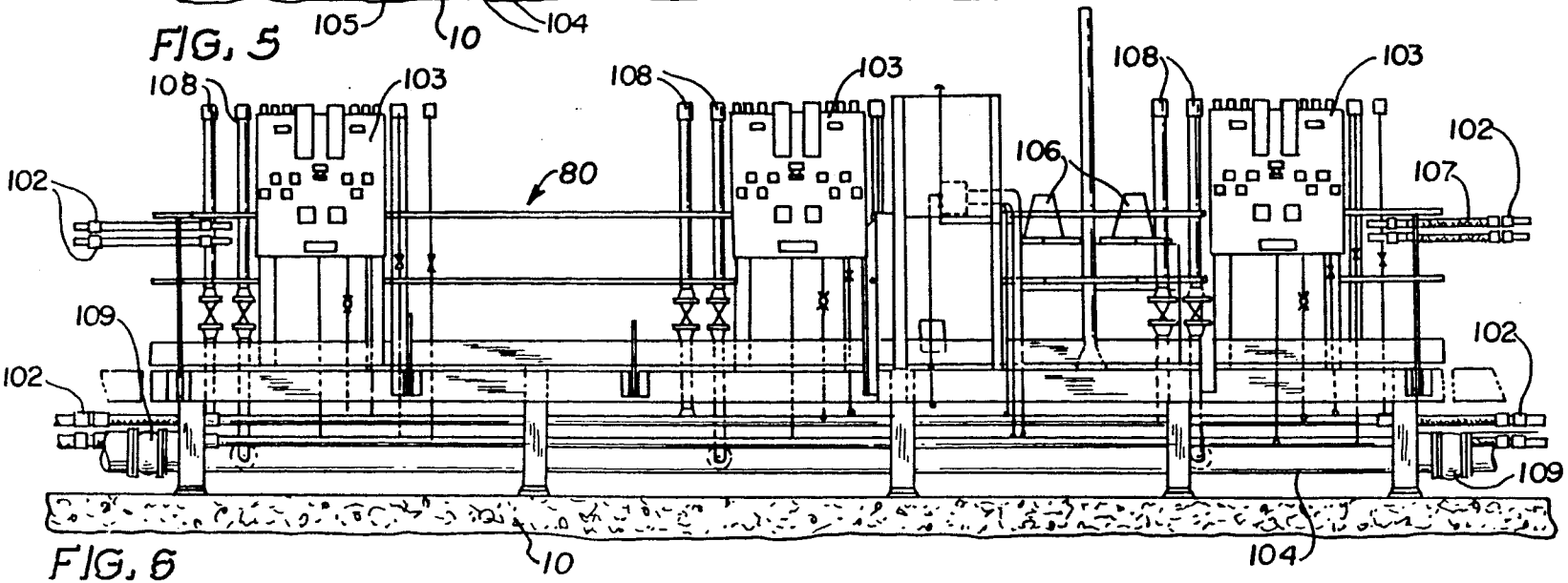
FIG. 6 is a side elevation of the interconnect module of FIG. 5.
Figure 8:
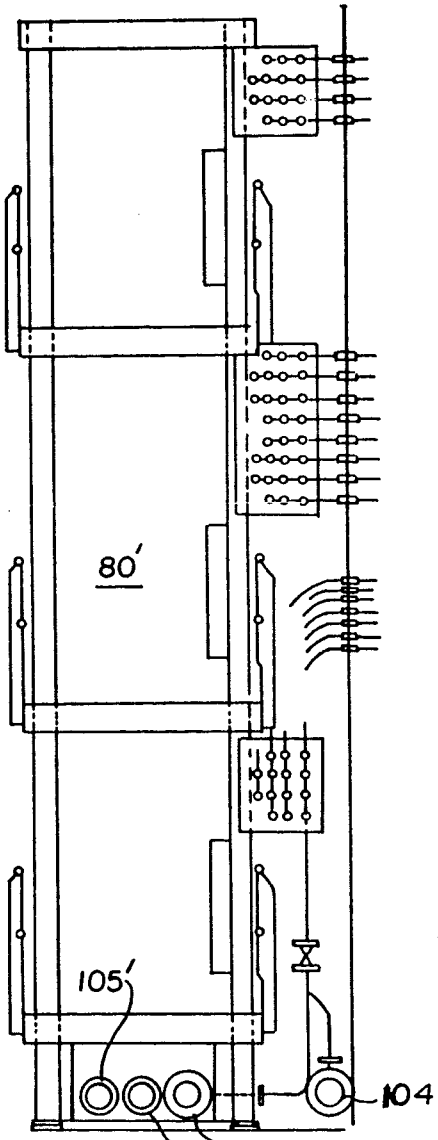
FIG. 8 is an end elevation of the interconnect module of FIG. 7.
Figure 7:
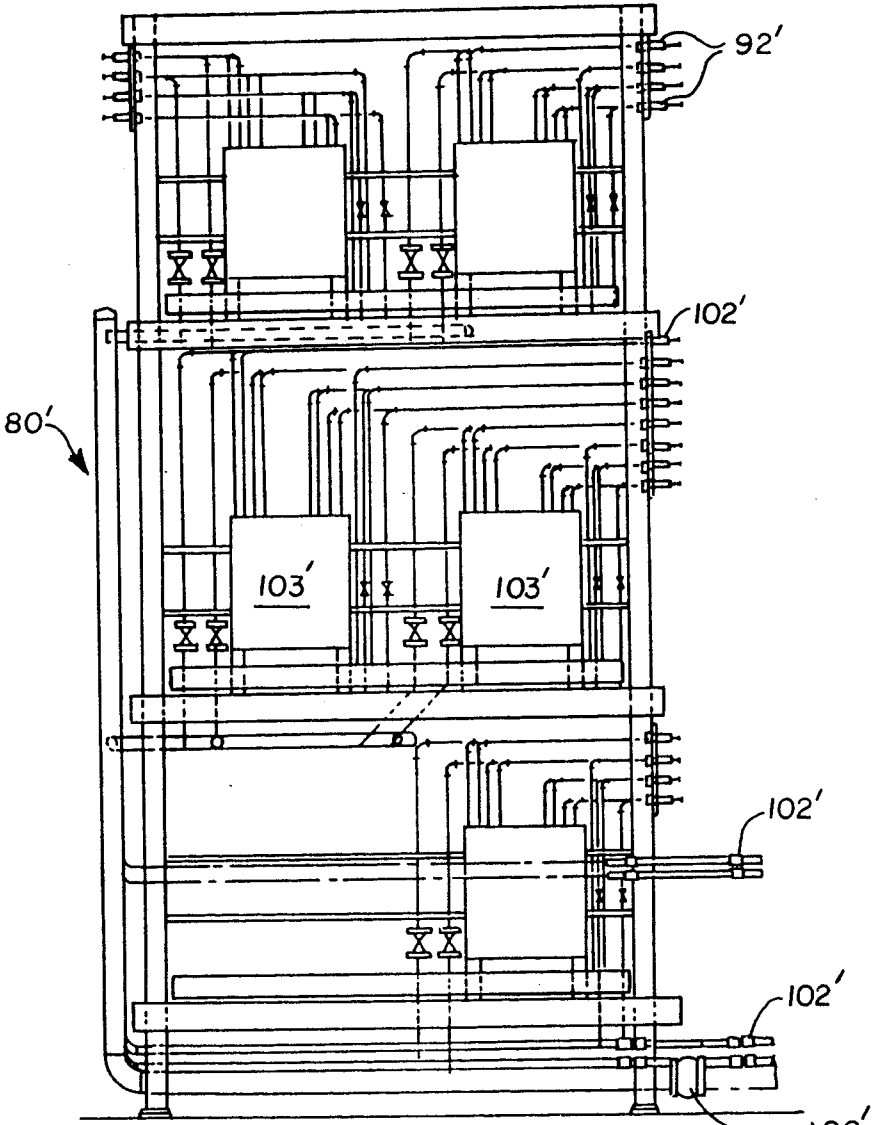
FIG. 7 is a side elevational view of the interconnect module for a straight mold modular caster.

This embodiment is provided with an interconnecting module 80', FIG. 6 and FIG. 7, of the same form as that used with the curved mold embodiment except for being higher at the mold modules to accommodate the greater height of the mold and segments at that point.

In the foregoing specification, I have set out certain preferred practices and embodiments of this invention, however, it will be understood that this invention may be otherwise embodied within the scope of the following claims.

I claim:

1. In a continuous caster of the type having a mold assembly followed by a plurality of roll segments and related components for handling and treating a cast strand discharged from beneath the mold, a mold oscillator apparatus comprising:

a mold oscillator frame including structural legs supporting an upper base frame portion;

a pair of spaced shafts, each shaft having first and second ends mounted for rotation on the upper base frame portion, the first and second ends having offset cylindrical portions thereon, four bearing blocks joined on the eccentric shafts adjacent the first and second ends thereof and defining eccentrics at said shaft ends;

a pair of elongated, wide flange beam members having upper and lower flanges interconnected by a web, each beam extending above one of the pair of spaced eccentric shafts and mounted on a lower flange respectively at each end to one of the bearing blocks of the eccentrics;

said oscillator base frame including a mold table comprising a planar frame-like structure adapted to support the mold thereon, said mold table rigidly secured to the respective upper flanges of said beam members;

oscillator drive means for rotating said pair of shafts and said eccentrics at a controlled rate whereby a controlled vertical oscillatory motion is transmitted from said eccentrics through the web portions of said wide flange beams to the mold table and thence to the mold situated thereon.

2. The mold oscillator apparatus of claim 1 wherein the mold has a pair of broad face plates which are curved comprising an inner curved face plate and a spaced outer curved face plate adapted to form a curved strand of cast metal and wherein the second ends of the eccentric shafts are positioned beneath an outer end of the mold table and said second ends having a greater offset than said first ends, whereby, said vertical oscillatory motion at said second ends has a greater vertical throw than a vertical throw at said first ends.

3. The mold oscillator apparatus of claim 1 wherein the upper base frame portion of the oscillator frame has an open side formed therein to permit easy placement and removal of casting machine components therethrough.

4. The mold oscillator apparatus, of claim 1 wherein the oscillator frame includes segment support means thereon adapted to receive and support a first roll segment module therein.

5. The apparatus of claim 4 wherein the segment support means includes adjustment means adapted to permit the movable adjustment of the first roll segment module both in a horizontal plane and pivotally about an axis parallel to said horizontal plane.

6. In a continuous caster of the type having a mold assembly followed by a plurality of roll segments and related components for handling and treating a cast strand, in combination, a mold oscillator frame and a first adjustable curved roll segment comprising:

a said mold oscillator frame having spaced-apart structural legs carrying an upper base frame portion positioned beneath and supporting the mold assembly, said oscillator frame also carrying segment support means thereon;

said first adjustable roll segment comprising a frame element having laterally extending feet on opposed sides thereof and a plurality of spaced roll sets mounted for rotation in said frame element, said feet adapted to be received and locked in said segment support means;

said segment support means including adjustment means to permit separate horizontal and rotation adjustment of said segment support means and the first roll segment carried therein, whereby said first roll segment is aligned between said mold assembly and a following roll segment.

7. The oscillator frame and first roll segment combination of claim 6 wherein the segment support means includes hydraulic clamping means for locking said segment feet therein.

8. In a continuous caster of the type having a mold assembly followed by a plurality of roll segments and related components for handling and treating a cast strand, a straightening module comprising:

a frame means having slots therein to compensate for thermal expansion;

a plurality of spaced-apart roll sets defining a plurality of strand bending points therealong whereby a cast strand entering said straightening module passes through said roll sets and is bent from a curved to a straight configuration.

9. The continuous caster of claim 8, including a starter bar handling and charging module situated downstream from the plurality of roll segments and related components for handling and treating the cast strand, said starter bar handling and charging module comprising structural frame means having a carrier pivotally movable thereon from a first vertical position to a second horizontal position, said carrier adapted to support a starter bar charging car thereon; and starter bar decoupling means for releasing a starter bar head from a cast strand.

10. The continuous caster of claim 9 including starter bar charging car means associated therewith.

11. The continuous caster of claim 10 wherein the charging car means comprises a motorized wheeled device movably mounted on said carrier and having clamping means associated therewith to receive and carry a starter bar after the head thereof is released from a cast strand by said decoupling means and adapted to travel on a horizontal trackway on said casting machine to deliver said starter bar to a mold assembly for commencing a next casting run.

12. The continuous caster of claim 11 wherein the charging car means includes a car frame having a pair of fixed arms extending outwardly at opposed ends of said frame and a movable arm pivotally mounted on said frame, for said fixed and movable arms having releasable gripping means and end portions thereof for selectively gripping and releasing said starter bar, whereby, upon first rotation of said movable arm said starter bar is loaded onto said charging car from the casting machine and upon a reverse rotation and a second rotation of said movable arm said starter bar is delivered to said mold assembly.

13. In a continuous caster of the type having a mold assembly followed by a plurality of roll segments, motors and related components for handling and treating a cast strand, service module means including a plurality of futility modules and interconnecting modules having pre-wired and pre-piped conduit, fittings and control means for the supply of utility services such as electric, water, hydraulic, air to the roll segments, motors and related components of the casting machine, said service module means constructed in a shippable size and including fitting means for easily interconnecting the modules with other modules and with like fittings associated with the casting machine.

* * * * *

UNITED STATES PATENT AND TRADEMARK OFFICE

CERTIFICATE OF CORRECTION

PATENT NO. : 4,953,614

DATED : September 4, 1990

INVENTOR(S) : Herbert Lemper

It is certified that error appears in the above-identified patent and that said Letters Patent is hereby corrected as shown below:

On the title page:

Under References Cited U.S. PATENT DOCUMENTS insert
--2,698,467 1/1955 Tarquinee et a . .
2,814,843 12/1957 Savage et al. .
2,920,359 1/1960 Easton et al. .
3,528,485 9/1970 Vogel .
3,563,298 2/1971 Stauffer et al. .
3,580,325 5/1971 Schrewe .
3,623,533 11/1971 Khorev et al. .
3,718,177 2/1973 Wagner, Jr. .
3,753,651 8/1973 Gallucci et al. .
3,765,470 10/1973 Huber .
3,794,107 2/1974 Bollig et al. .
3,776,298 12/1973 Vogt ... 164/154
4,023,612 5/1977 Jackson .
4,129,173 12/1978 Scheurecker et al. ... 164/442
4,502,527 3/1985 Brewer ... 164/418
4,532,981 8/1985 Hargassner et al. ... 164/483--.

Column 6 Line 10 "37, The" should read --37'. The--.

UNITED STATES PATENT AND TRADEMARK OFFICE

CERTIFICATE OF CORRECTION

PATENT NO. : 4,953,614

DATED : September 4, 1990

INVENTOR(S) : Herbert Lemper

It is certified that error appears in the above-identified patent and that said Letters Patent is hereby corrected as shown below:

Column 6 Line 50 "37," should read --37'--.

Column 8 Line 49 "51," should read --51'--.

Column 9 Line 21 "51,," should read --51',--.

Column 11 Lines 54-55 "66 then returns to the rotating frame 69" should read --69 then returns to the rotating frame 66--.

Column 11 Line 68 "77," should read --77'--.

Claim 4 Line 67 Column 13 after "apparatus" delete --,--.

Signed and Sealed this

Twelfth Day of May, 1992

*Attest:*

DOUGLAS B. COMER

*Attesting Officer*

*Acting Commissioner of Patents and Trademarks*